US010336533B2

(12) United States Patent
Surjaatmadja et al.

(10) Patent No.: US 10,336,533 B2
(45) Date of Patent: Jul. 2, 2019

(54) COLLAPSIBLE PARTICULATE MATTER CONTAINER

(71) Applicant: Halliburton Energy Services, Inc., Houston, TX (US)

(72) Inventors: Jim Basuki Surjaatmadja, Duncan, OK (US); Tim H. Hunter, Ducan, OK (US); Calvin L. Stegemoeller, Duncan, OK (US); Bryan John Lewis, Duncan, OK (US); Austin Carl Schaffner, Duncan, OK (US); Bryan Chapman Lucas, Duncan, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 15/743,596

(22) PCT Filed: Aug. 13, 2015

(86) PCT No.: PCT/US2015/045019

§ 371 (c)(1),
(2) Date: Jan. 10, 2018

(87) PCT Pub. No.: WO2017/027034

PCT Pub. Date: Feb. 16, 2017

(65) Prior Publication Data

US 2018/0201437 A1 Jul. 19, 2018

(51) Int. Cl.
*B65D 88/52* (2006.01)
*B65D 88/12* (2006.01)
(Continued)

(52) U.S. Cl.
CPC ..... *B65D 88/12* (2013.01); *B65D 88/26* (2013.01); *B65D 88/28* (2013.01); *B65D 88/52* (2013.01);
(Continued)

(58) Field of Classification Search
CPC ..... B65D 88/027; B65D 88/52; B65D 90/205
See application file for complete search history.

(56) References Cited

U.S. PATENT DOCUMENTS 5,437,384 A * 8/1995 Farrell ..... B65D 19/12 220/1.5
5,722,552 A * 3/1998 Olson ..... B65D 77/061 206/512

(Continued)

FOREIGN PATENT DOCUMENTS

| | | |
|---|---|---|
| CN | 102530435 A | 7/2012 |
| CN | 203497769 U | 3/2014 |
| WO | 2009/038518 A1 | 3/2009 |

OTHER PUBLICATIONS

International Preliminary Report on Patentability issued in related PCT Application No. PCT/US2015/045019 dated Feb. 22, 2018, 10 pages.

(Continued)

*Primary Examiner* — Mark C Hageman
(74) *Attorney, Agent, or Firm* — John W. Wustenberg; Baker Botts L.L.P.

(57) ABSTRACT

In accordance with presently disclosed embodiments, a collapsible and optionally stackable storage container for bulk material is provided. The disclosed storage container includes a collapsible frame defined by a rigid upper support structure, a rigid lower support structure and a support member coupled at one end to the upper support structure and coupled at another end to the lower support structure. An actuator is also provided which is coupled to the support member at one end. The disclosed storage container further includes a storage sack having an upper portion coupled to the upper support structure and a lower portion coupled to the lower support structure. The lower portion of the storage sack is generally taper-shaped and may be equipped with a
(Continued)

discharge opening that enables release of the bulk material onto a conveyor, which may be employed when the collapsible storage container is integrated into a bulk storage system.

19 Claims, 5 Drawing Sheets

(51) Int. Cl.

| | |
|---|---|
| ***B65D 88/26*** | (2006.01) |
| ***B65D 88/66*** | (2006.01) |
| ***B65D 90/54*** | (2006.01) |
| ***B65D 88/28*** | (2006.01) |
| *B65D 88/02* | (2006.01) |
| *B65D 90/12* | (2006.01) |
| *B65D 90/66* | (2006.01) |

(52) U.S. Cl.
CPC ..... *B65D 88/66* (2013.01); *B65D 90/54* (2013.01); *B65D 88/022* (2013.01); *B65D 90/12* (2013.01); *B65D 90/66* (2013.01)

(56) References Cited

U.S. PATENT DOCUMENTS 5,897,012 A * 4/1999 Sortwell ..... B65D 19/12 206/600
6,968,946 B2 * 11/2005 Shuert ..... B65D 19/0028 206/386
D688,349 S 8/2013 Oren et al.
D688,350 S 8/2013 Oren et al.
D688,351 S 8/2013 Oren et al.
D688,772 S 8/2013 Oren et al.
8,827,118 B2 9/2014 Oren
9,016,378 B2 * 4/2015 Zhang ..... E21B 43/00 166/245
9,428,330 B2 * 8/2016 Lopez ..... B65D 88/027
9,714,122 B2 * 7/2017 Snape ..... B65D 88/66
9,751,691 B2 * 9/2017 Hunter ..... B65D 88/1668
2013/0206415 A1 8/2013 Sheesley
2013/0206753 A1 * 8/2013 Zhang ..... B65D 88/027 220/9.2
2014/0083554 A1 3/2014 Harris
2014/0299225 A1 10/2014 Oren
2015/0003955 A1 * 1/2015 Oren ..... B65G 65/42 414/810
2015/0044004 A1 2/2015 Pham et al.
2015/0086307 A1 * 3/2015 Stefan ..... B65D 88/005 414/304
2015/0203288 A1 7/2015 Hunter

OTHER PUBLICATIONS

International Search Report and Written Opinion issued in related PCT Application No. PCT/US2015/045019 dated May 2, 2016, 13 pages.

* cited by examiner

COLLAPSIBLE PARTICULATE MATTER CONTAINER

CROSS-REFERENCE TO RELATED APPLICATION

The present application is a U.S. National Stage Application of International Application No. PCT/US2015/045019 filed Aug. 13, 2015, which is incorporated herein by reference in its entirety for all purposes.

TECHNICAL FIELD

The present disclosure relates generally to transferring dry bulk materials, and more particularly, to a transportable particulate matter container which is collapsible.

BACKGROUND

During the drilling and completion of oil and gas wells, various wellbore treating fluids are used for a number of purposes. For example, high viscosity gels are used to create fractures in oil and gas bearing formations to increase production. High viscosity and high density gels are also used to maintain positive hydrostatic pressure in the well while limiting flow of well fluids into earth formations during installation of completion equipment. High viscosity fluids are used to flow sand into wells during gravel packing operations. The high viscosity fluids are normally produced by mixing dry powder and/or granular materials and agents with water at the well site as they are needed for the particular treatment. Systems for metering and mixing the various materials are normally portable, e.g., skid- or truck-mounted, since they are needed for only short periods of time at a well site.

The powder or granular treating material is normally transported to a well site in a commercial or common carrier tank truck. Once the tank truck and mixing system are at the well site, the dry powder material (bulk material) must be transferred or conveyed from the tank truck into a supply tank for metering into a blender as needed. The bulk material is usually transferred from the tank truck pneumatically. More specifically, the bulk material is blown pneumatically from the tank truck into an on-location storage/delivery system (e.g., silo). The storage/delivery system may then deliver the bulk material onto a conveyor or into a hopper, which meters the bulk material through a chute into a blender tub.

Recent developments in bulk material handling operations involve the use of portable containers for transporting dry material about a well location. The containers can be brought in on trucks, unloaded, stored on location, and manipulated about the well site when the material is needed. The containers are generally easier to manipulate on location than a large supply tank trailer. The containers are eventually emptied by dumping the contents thereof onto a mechanical conveying system (e.g., conveyor belt, auger, bucket lift, etc.). The conveying system then moves the bulk material in a metered fashion to a desired destination at the well site.

BRIEF DESCRIPTION OF THE DRAWINGS

For a more complete understanding of the present disclosure and its features and advantages, reference is now made to the following description, taken in conjunction with the accompanying drawings, in which.

DETAILED DESCRIPTION

Figure 1:
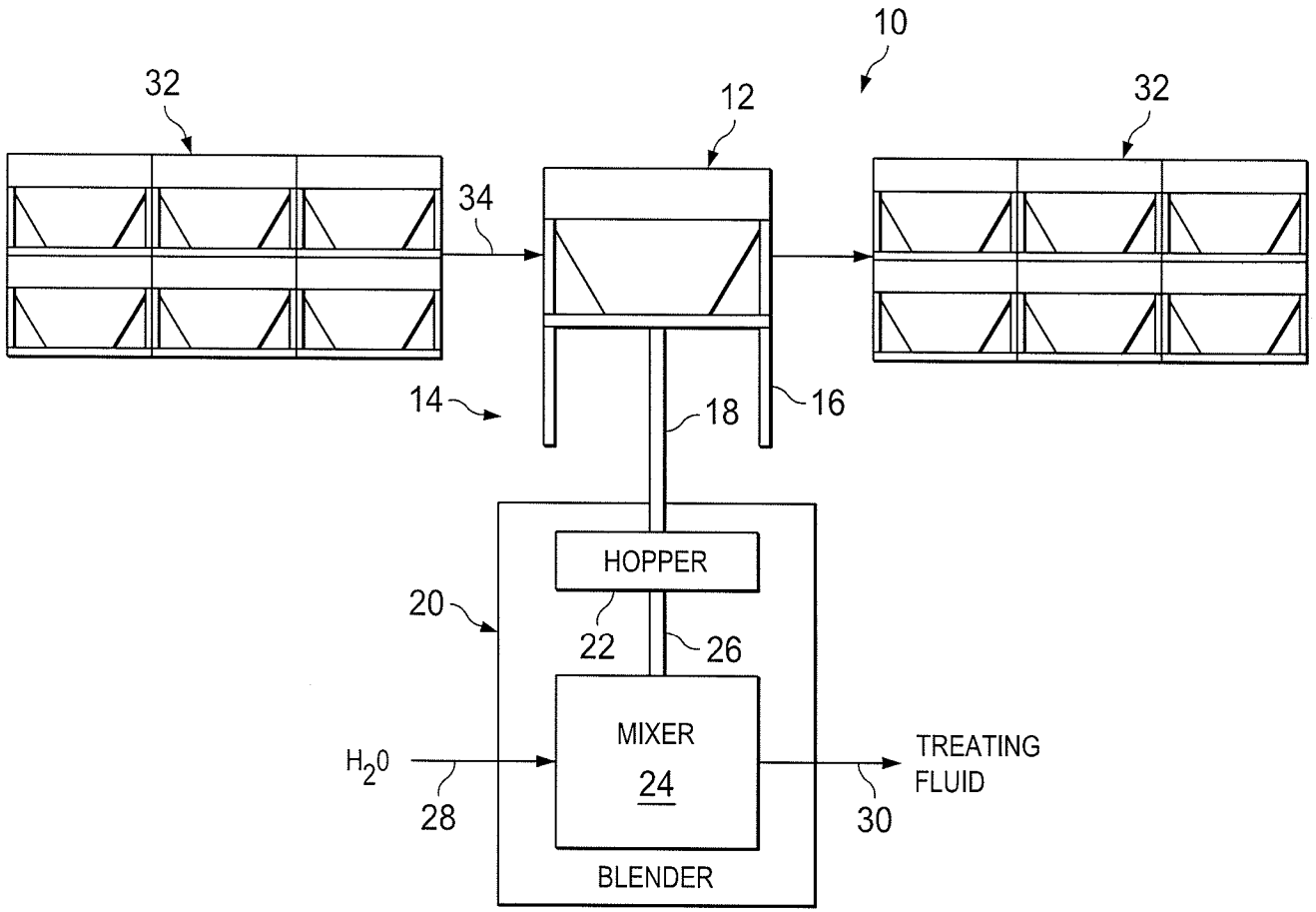
FIG. 1 is a schematic block diagram of a bulk material handling system suitable for releasing bulk material from a collapsible container in accordance with the present disclosure disposed on a portable support structure.

Illustrative embodiments of the present disclosure are described in detail herein. In the interest of clarity, not all features of an actual implementation are described in this specification. It will of course be appreciated that in the development of any such actual embodiment, numerous implementation specific decisions must be made to achieve developers' specific goals, such as compliance with system related and business related constraints, which will vary from one implementation to another. Moreover, it will be appreciated that such a development effort might be complex and time consuming, but would nevertheless be a routine undertaking for those of ordinary skill in the art having the benefit of the present disclosure. Furthermore, in no way should the following examples be read to limit, or define, the scope of the disclosure.

Certain embodiments according to the present disclosure may be directed to containers and systems for efficiently managing bulk material (e.g., bulk solid or liquid material) delivery to a well site. Bulk material handling systems are used in a wide variety of contexts including, but not limited to, drilling and completion of oil and gas wells, concrete mixing applications, agriculture, and others. The disclosed embodiments are directed to containers and systems for efficiently moving bulk material into a blender inlet of a blender unit at a job site. The collapsible and optionally stackable containers are designed to be efficiently delivered to a well site and returned to a central location for refilling. The bulk material systems are designed to include a plurality of the collapsible containers which may be modularly loaded onto a skid, which can be efficiently delivered to the well site. The disclosed techniques may be used to efficiently handle any desirable bulk material having a solid or liquid constituency including, but not limited to, sand, proppant, gel particulate, diverting agent, dry-gel particulate, liquid additives and others.

In currently existing on-site bulk material handling applications, dry material (e.g., sand, proppant, gel particulate, or dry-gel particulate) may be used during the formation of treatment fluids. In such applications, the bulk material is often transferred between transportation units, storage tanks, blenders, and other on-site components via pneumatic transfer, sand screws, chutes, conveyor belts, and other components. Recently, a new method for transferring bulk material to a hydraulic fracturing site involves using portable containers to transport the bulk material. The containers can be brought in on trucks, unloaded, stored on location, and manipulated about the site when the material is needed. These containers generally include a discharge gate at the bottom that can be actuated to empty the material contents of the container at a desired time.

In existing systems, the containers are generally supported above a mechanical conveying system (e.g., moving belt, auger, bucket lift, etc.) prior to releasing the bulk material. The discharge gates on the containers are opened to release the bulk material via gravity onto the moving mechanical conveying system. The mechanical conveying system then directs the dispensed bulk material toward a desired destination, such as a hopper on a blender unit. Unfortunately, this process can release a relatively large amount of dust into the air and result in unintended material spillage. In addition, the mechanical conveying system is generally run on auxiliary power and, therefore, requires an external power source to feed the bulk material from the containers to the blender.

The material handling systems having the portable and collapsible support structure disclosed herein are designed to address and eliminate the shortcomings associated with existing container handling systems. The portable support structure includes a frame for receiving and holding one or more portable collapsible and optionally stackable bulk material containers in an elevated position proximate the blender inlet (e.g., blender hopper or mixer inlet), as well as one or more gravity feed outlets for routing the bulk material from the containers directly into the blender inlet. In some embodiments, the portable support structure may be transported to the well site on a trailer, unloaded from the trailer, and positioned proximate the blender unit. In other embodiments, the portable support structure may be a mobile support structure that is integrated into a trailer unit. The portable support structure may be designed with an open space at one side so that the blender unit can be backed up until the blender inlet is in position directly under the gravity feed outlet(s) of the support structure.

The disclosed portable support structure may provide an elevated location for one or more bulk material containers to be placed while the proppant (or any other liquid or solid bulk material used in the fluid mixtures at the job site) is transferred from the containers to the blender. The support structure may elevate the bulk material containers to a sufficient height above the blender inlet and route the bulk material directly from the containers to the blender inlet. This may eliminate the need for any subsequent pneumatic or mechanical conveyance of the bulk material (e.g., via a separate mechanical conveying system) from the containers to the blender. This may improve the energy efficiency of bulk material handling operations at a job site, since no auxiliary power sources are needed to move the material from the containers into the blender inlet. In addition, the portable support structure may simplify the operation of transferring bulk material, reduce material spillage, and decrease dust generation.

Turning now to the drawings, FIG. 1 is a block diagram of a bulk material handling system 10 illustrating the collapsible storage containers in accordance with present disclosure in a stacked configuration. As those of ordinary skill in the art will appreciate, the collapsible storage containers in accordance with present invention may or may not be stacked. The system 10 includes collapsible storage container 12, which will be described in further detail below, which is elevated on a portable support structure 14 and holding a quantity of bulk material (e.g., solid or liquid treating material). The portable support structure 14 may include a frame 16 for receiving and holding the container 12 and a gravity-feed outlet 18 for directing bulk material away from the container 12. The outlet 18 may be coupled to and extending from the frame 16. The outlet 18 may utilize a gravity feed to provide a controlled, i.e., metered, flow of bulk material from the container 12 to a blender unit 20.

As illustrated, the blender unit 20 may include a hopper 22 and a mixer 24 (e.g., mixing compartment). The blender unit 20 may also include a metering mechanism 26 for providing a controlled, i.e. metered, flow of bulk material from the hopper 22 to the mixer 24. However, in other embodiments the blender unit 20 may not include the hopper 22, such that the outlet 18 of the support structure 14 may provide bulk material directly into the mixer 24.

Water and other additives may be supplied to the mixer 24 (e.g., mixing compartment) through a fluid inlet 28. As those of ordinary skill in the art will appreciate, the fluid inlet 28 may comprise more than the one input flow line illustrated in FIG. 1. The bulk material and liquid ingredients may be mixed in the mixer 24 to produce (at an outlet 30) a fracing fluid, a mixture combining multiple types of proppant, proppant/dry-gel particulate mixture, sand/sand-diverting agents mixture, cement slurry, drilling mud, a mortar or concrete mixture, or any other fluid mixture for use on location. The outlet 30 may be coupled to a pump for conveying the treating fluid to a desired location (e.g., a hydrocarbon recovery well) for a treating process. It should be noted that the disclosed system 10 may be used in other contexts as well. For example, the bulk material handling system 10 may be used in concrete mixing operations (e.g., at a construction site) to dispense aggregate from the container 12 through the outlet 18 into a concrete mixing apparatus (mixer 24). In addition, the bulk material handling system 10 may be used in agriculture applications to dispense grain, feed, seed, or mixtures of the same.

It should be noted that the disclosed container 12 may be utilized to provide bulk material for use in a variety of treating processes. For example, the disclosed systems and methods may be utilized to provide proppant materials into fracture treatments performed on a hydrocarbon recovery well. In other embodiments, the disclosed techniques may be used to provide other materials (e.g., non-proppant) for diversions, conductor-frac applications, cement mixing, drilling mud mixing, and other fluid mixing applications.

As illustrated, the container 12 may be elevated above an outlet location via the frame 16. The support structure 14 is designed to elevate the container 12 above the level of the blender inlet (e.g., blender hopper 22 and/or mixing tub 24) to allow the bulk material to gravity feed from the container 12 to the blender unit 20. This way, the container 12 is able to sit on the frame 16 of the support structure 14 and output bulk material directly into the blender unit 20 via the gravity feed outlet 18 of the support structure 14.

Although shown as supporting a single container 12, other embodiments of the frame 16 may be configured to support multiple containers 12. In particular, the frame structure 16 may be a skid or other transportation unit. One such exemplary transportation unit is the Mountain Mover® trailer system marketed by the present assignee. The Mountain Mover® trailer has a bin capable of storing 2,500 $ft^3$ (70.8 $m^3$) of proppant and is equipped with a self-contained hydraulic power package. A portable level sensor and automatic remote controls help to maintain a constant sand level in the hopper when discharging. The Mountain Mover® unit allows operators to manage inventory and have the gates open in a specific sequence. The unit may optionally be equipped with a hydraulic backup system that can be run by another comparably equipped Mountain Mover® unit or a separately provided hydraulic power package. The collapsible storage containers 12 in accordance with the present disclosure may be utilized to make up the storage bin area of the existing Mountain Mover® storage system. The exact number of containers 12 that may be implemented in such a system may depend on a combination of factors such as, for example, the volume, width, and weight of the containers 12 to be disposed thereon.

In any case, the container(s) 12 may be completely separable and transportable from the frame 16, such that any container 12 may be selectively removed from the frame 16 and replaced with another container 12. That way, once the bulk material from the container 12 runs low or empties, a new container 12 may be placed on the frame 16 to maintain a steady flow of bulk material to an outlet location. In some instances, the container 12 may be closed before being completely emptied, removed from the frame 16, and replaced by a container 12 holding a different type of bulk material to be provided to the outlet location. The collapsible nature of the container 12 enables transportation the containers to be stacked when transporting back to the material source location. By being able to collapse the containers 12, multiple containers can occupy the space previously occupied by a single container. This enables efficient use of space and resources at the well site location. It also helps to minimize traffic into and out of a well site, which can be challenge to manage in certain remote and tight locations.

Figure 2:
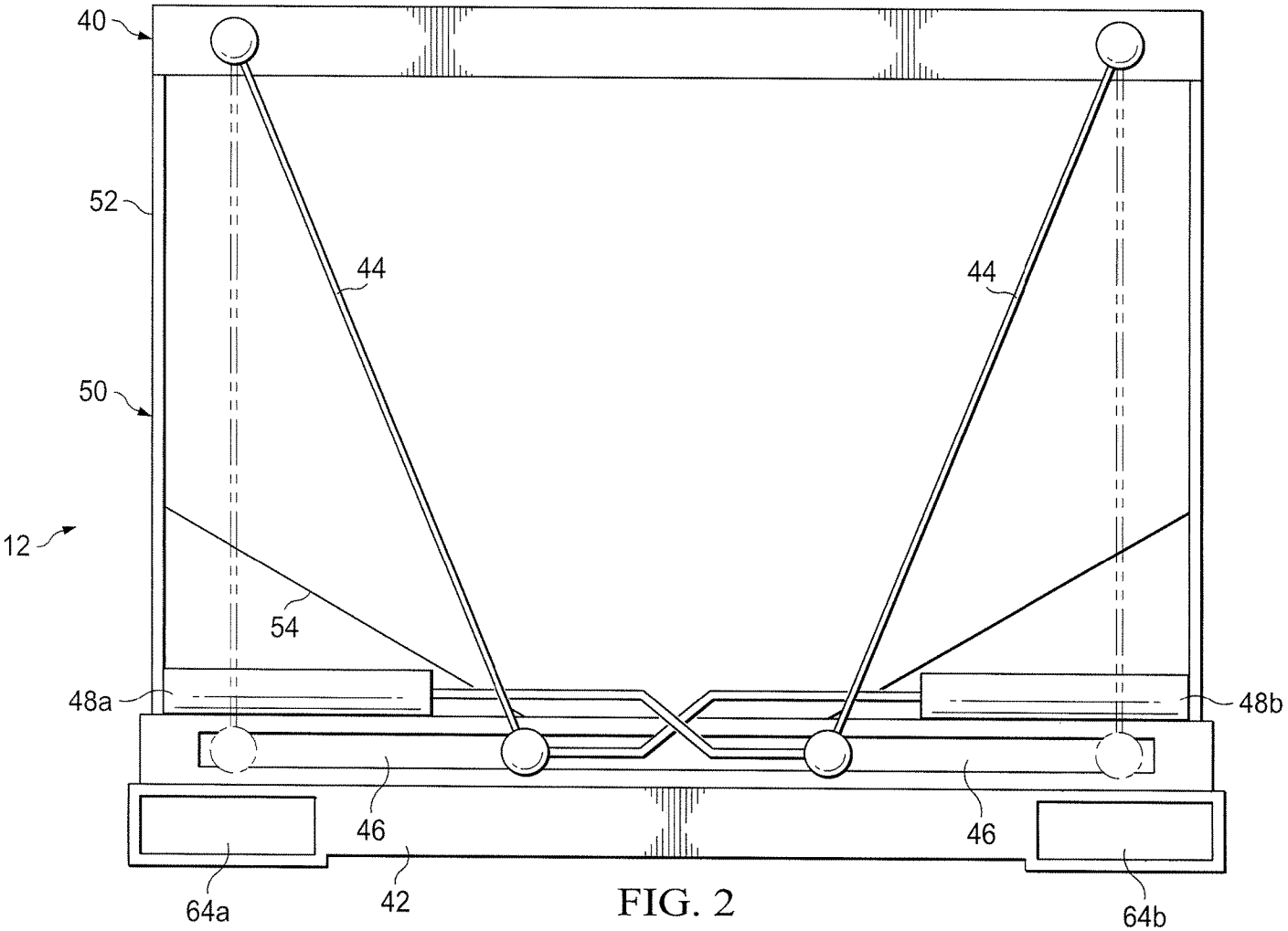
FIG. 2 is a schematic diagram of an embodiment of the collapsible particulate matter container in accordance with the present disclosure.

Turning to FIG. 2, the details of the collapsible and optionally stackable bulk storage container 12 in accordance with the present disclosure is shown. Preferably, the container 12 is designed to hold 100-500 cubic feet of proppant. The bottom structure of the container 12 is also optionally designed to have a construction where a fork lift can be used to move the full or empty container, as further explained below. For practical purposes, the bottom of the container 12 may have a conical shape, e.g., 20-30 degrees square cone, for better downward flow of the particulate matter, as illustrated in the bottom half of the drawing shown in FIG. 2. While steeper angles may be better for the particulate flow, this cone could be equipped with one or more sonic or ultrasonic vibrators to help particles to slide easily downward. The walls of the containment portion of the container 12 (later referred to as the storage sack) may be, in one exemplary embodiment, made of cloth, which could be made of a woven nylon or glass, covered (or dipped) with nitrile rubber/elastomer. The conical-shaped section of the containment portion of the container 12 may be formed of the same cloth material as the walls.

The collapsible container 12 is preferably constructed such that the top frame, which may be a rectangular or in one exemplary embodiment a square shape, has a matching construction or shape on the bottom (the bottom frame), and when folded, securely locks the bottom frame to the top frame, while at the same time safely containing/protecting the soft structure of the containment portion (storage sack) between the two stiff/rigid top and bottom frames.

The top frame houses a port, which may be used for filling the container 12. It may be a simple open port that can be closed manually when so needed, or alternatively, it can be a port that can be automatically open when a matching delivery structure is inserted. It may also even be designed such that the delivery structure opens and seals the connection between the two ports. In another exemplary construction, the delivery structure may actually be the bottom of the container 12. This would allow stacking of the containers one on top of the other, where each upper container 12 could automatically fill the lower ones when so stacked. Sensors, e.g., an optical sensor disposed at the output port of the container 12, could be utilized to indicate an "empty status" of each container. Alternatively, the frequency response of the sonic/ultrasonic vibrators could be used to determine the empty status of the container 12.

The containers 12 would be filled at a central bulk material source location. They would then be delivered to the well site using conventional delivery means. Forklifts are the preferred method for moving the containers 12 around the plant and well site given their pervasive use in other well operations. It should be further noted, as those of ordinary skill in the art will appreciate, that while the containers 12 are primarily designed for delivering sand, proppant, and possibly additives used in the fracturing process, it is also suitable for cement transport as well and other applications.

As noted above, the containers may be implemented into the existing Mountain Mover® storage system. One way in which they may be implemented into such a system is by extending the volume of the each compartment of the Mountain Mover® storage system. To do this, the walls do not have to have any bottom (such as would otherwise be necessary to accommodate the folks of a forklift, as would be the case in the use of individual containers) so as the top structure is lifted, it is open to the lower part of the compartment. Furthermore, the lower conical structure feature would also not be necessary in such an application. Furthermore, a matching container can be stacked on it to further enhance its capacity.

With further reference to FIG. 2, additional details of the collapsible container 12 will now be described. The container 12 includes a collapsible frame. The collapsible frame includes a rigid upper support structure 40 and a rigid lower support structure 42. The upper support structure or frame 40 may take many different forms or configurations. In one exemplary embodiment, the upper support structure 40 is formed by connecting four bars or beams into a rectangular configuration. In one exemplary embodiment, the rectangular configuration is a square. Additional beams or other support structures may be provided to further strengthen the upper support structure 40. The cross-beams may be formed of any number of materials. Some exemplary materials include a metal alloy or composite material. Any other suitable rigid material may be utilized as those of ordinary skill in the art will recognize. The lower support structure or frame 42 may be formed in the same configuration and of the same materials as that of the upper support structure 40.

The collapsible frame further includes one or more support members 44 coupled at one end to the upper support structure 40 and coupled at another end to the lower support structure 42. The one or more support members may in one exemplary embodiment be a rod or bar which is fixed but pivots at one end located, for example, at the upper support structure 40 and which is restrained vertically at the other end, for example, at the lower support structure 42. In one exemplary embodiment, the support members 44 are allowed to slide horizontally along the lower support structure 42. They slide along one or more tracks 46. By sliding along tracks 46 the support members 44 enable the upper support structure 40 to expand and collapsible relative to the lower support structure 42 much like an accordion. In one exemplary embodiment, there are two support members 44 disposed on one side of the container 12, as illustrated in FIG. 2. There may also be two additional support members 45 on an opposite side of the container 12, as shown in FIG.

3. The dashed lines illustrate the support members 44 in their fully vertical orientation wherein the container 12 is at its full storage capacity configuration. The solid lines show the support members transitioning either between the expanded position to the collapsed position or vice versa. Alternatively, the container 12 may assume a partially collapsed configuration so that multiple containers containing bulk material can be stacked on the bed of a trailer, even though full of material to save space. The flexible nature of the material containment portion of the container as discussed below further enables this configuration.

Figure 3:
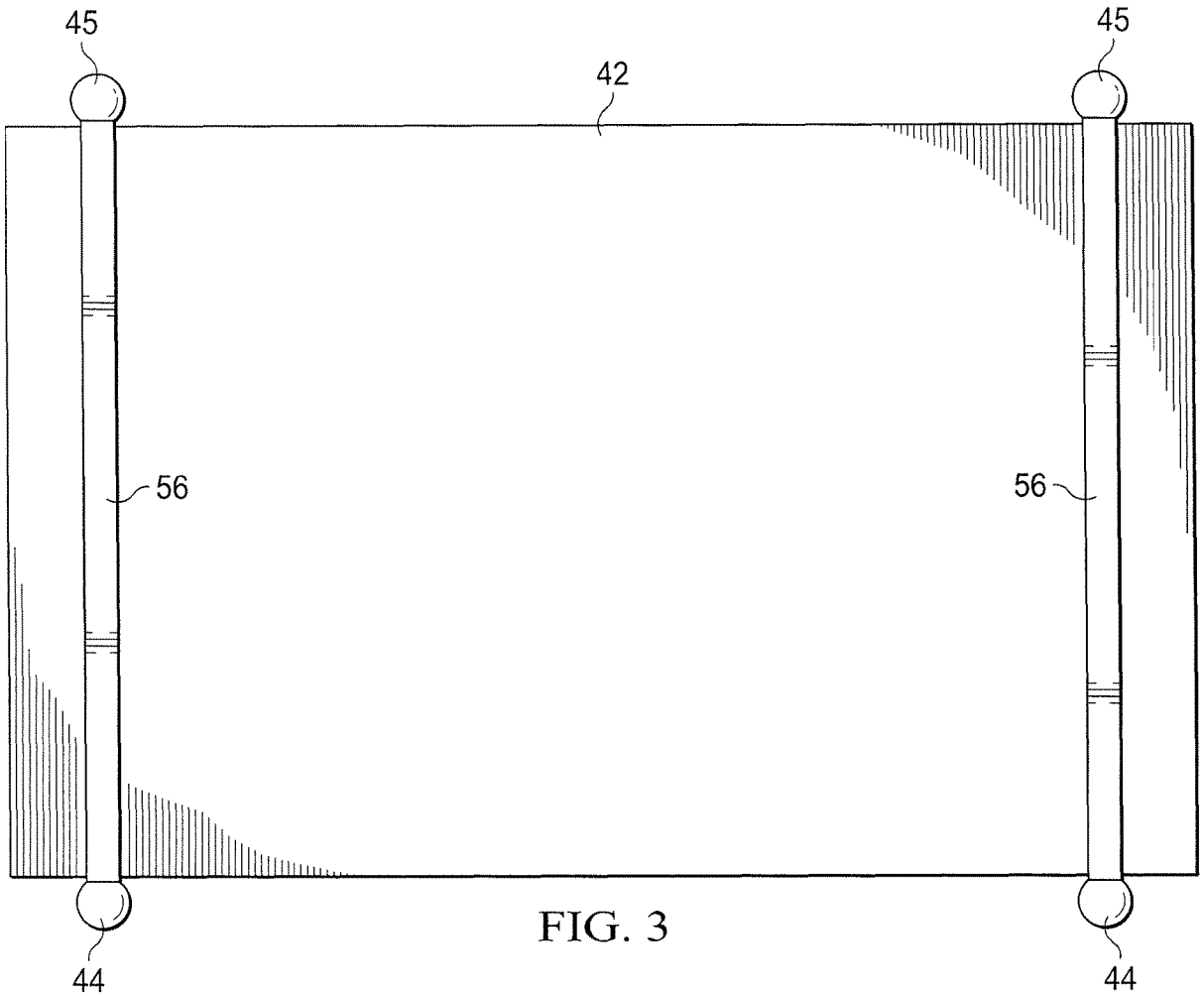
FIG. 3 is a bottom view (or alternatively top view) of the support structure of the collapsible frame making up the bulk storage container in accordance with the present disclosure illustrating the cross-bars which connect support members on opposite sides of the container.

Actuators 48*a* and 48*b* are coupled to the support members 44 at the ends secured within the tracks 46. By activation of the actuators 48*a* and 48*b*, the support members 44 move along the tracks 46 and thereby raise and lower, i.e., expand and collapse the upper support structure 40 relative to the lower support structure 42. One or more devices may be used as the actuators. They may be pneumatic cylinders, hydraulic cylinders, manually-operated cylinders, cylinders operated by an electric motor, linear actuators, ball cylinders or any combination thereof. Furthermore, the support structures 45 on the other side of the container may be connected to the support members 44 via cross-bars 56, as shown in FIG. 3. This enables the support members 45 to be activated by the actuators 48*a* and 48*b* thus obviating the need for a second pair of actuators 48 on the other side of the container 12.

Figure 4:
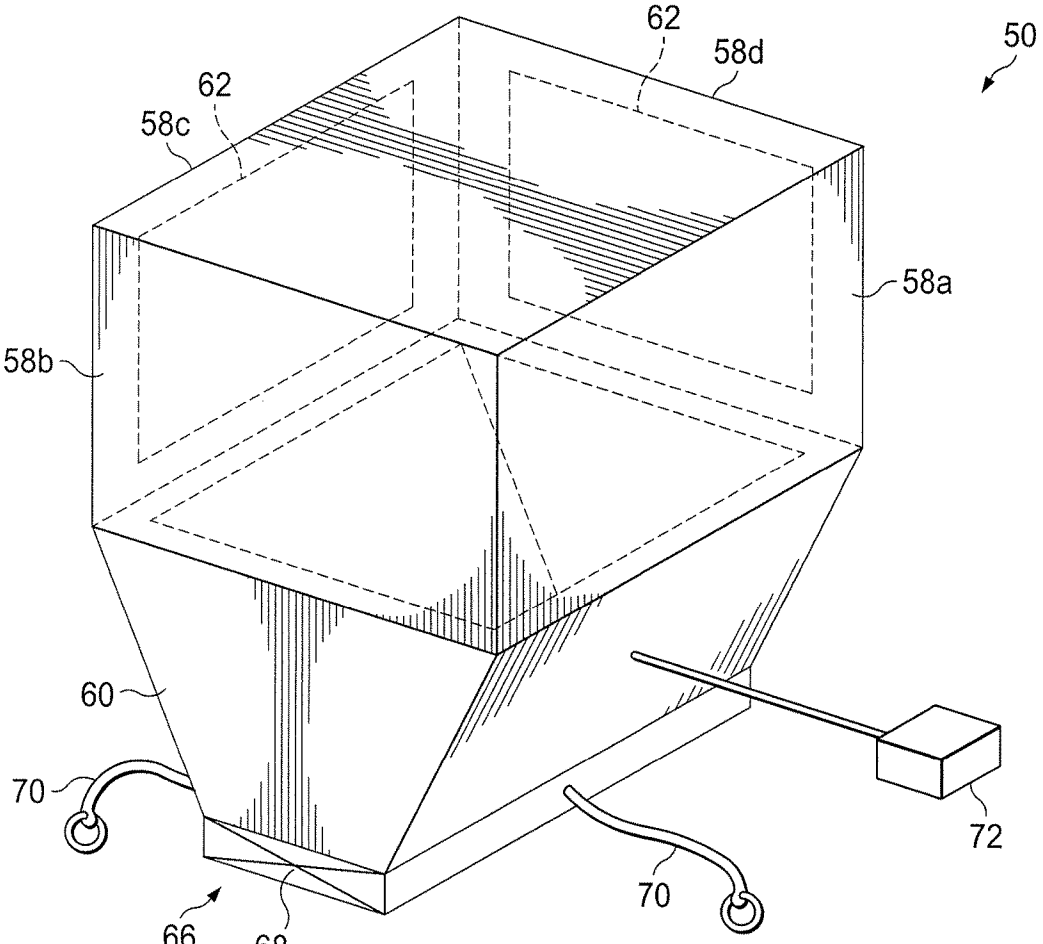
FIG. 4 is an elevation, perspective view of the storage sack portion of the collapsible container in accordance with the present disclosure.

The collapsible container 12 further includes a containment portion, which in one exemplary embodiment is a storage sack 50. The storage sack 50 is defined by an upper portion 52 coupled to the upper support structure 40 and a lower portion 54 coupled to the lower support structure 42. The upper portion 52 of the storage sack 50 may be formed of a plurality of attached rigid or semi-rigid panels, e.g., panels 58*a-d*, as shown in FIG. 4. The lower portion 54 of the storage sack 50 may be generally taper-shaped and formed of a generally flexible material 60. As noted above, the lower portion 54 may be conical in shape. In one exemplary embodiment, it is a 20-30 degree square cone. Having a generally taper or conical shape allows for better downward flow of the particulate matter.

In one exemplary embodiment, the storage sack 50 is formed of one of the following materials: a cloth, a canvas, a canvas coated with a rubber material, a canvas coated with an elastomeric material, a woven nylon, woven polyethylene, a plastic, a woven glass coated with a rubber material, a woven glass coated with an elastomeric material, a gunny sack and any combination thereof. The storage sack 50 has an interior which may also be formed of a plurality of connected tension panels 62, as shown in FIG. 4.

The container 12 may further include a pair of tubes 64*a* and 64*b* formed along opposite sides of the lower support frame 42, as shown in FIG. 2. In one exemplary embodiment, the pair of tubes 64*a* and 64*b* are formed as part of (i.e., integrated into) the lower support structure 42. The pair of tubes preferably has a generally rectangular cross-section, so as to be able to accommodate the forks of a forklift.

The container 12 further includes a discharge opening 66 formed in the lower portion 54 of the storage sack, as shown in FIG. 4. In one exemplary embodiment, the discharge opening 66 is equipped with a valve 68, which can control the flow rate of the material being discharged out of the container 12. Other material control devices may be used in place of the valve. Some other non-limiting examples include a swing gate, pinch gate, annular pinch valve, butterfly valve and combinations thereof. The container 12 may further include a rope 70 to couple or attach the lower portion 54 of the storage sack 50 to the lower support structure 42. Alternatively, a panel or other similar structure may be used to attach the lower portion 54 of the storage sack 50 to the lower support structure 42. The upper portion 52 of the storage sack 50 being semi-rigid may be attached to the upper support structure 40 by bolts, rivets, or other similar known securing means.

The container 12 may further include a sonic or ultrasonic vibrator 72 coupled to the lower portion 54 of the of the storage sack 50 to aid in the dispensing of the bulk material out of the container 12. As noted above, by monitoring the frequency of the storage sack 50's response to the vibration produced by the vibrator 72, the empty status of the container 12 may be monitored.

A portable bulk storage system 32 may be provided at the well site for storing one or more additional containers 12 of bulk material to be positioned on the frame 16 of the support structure 14, as shown in FIG. 1. The bulk material containers 12 may be transported to the desired location on a transportation unit (e.g., truck). The bulk storage system 32 may be the transportation unit itself or may be a skid, a pallet, or some other holding area. One or more containers 12 of bulk material may be transferred from the storage system 32 onto the support structure 14, as indicated by arrow 34. This transfer may be performed by lifting the container 12 via a hoisting mechanism, such as a forklift, a crane, or a specially designed container management device. In this embodiment, the containers 12 are stacked, one on top of another, as shown in FIG. 1.

When the one or more containers 12 are positioned on the support structure 14, discharge gates on one or more of the containers 12 may be opened, allowing bulk material to flow from the containers 12 into the outlet 18 of the support structure 14. The outlet 18 may then route the flow of bulk material directly into a blender inlet (e.g., into the hopper 22 or mixer 24) of the blender unit 20.

After one or more of the containers 12 on the support structure 14 are emptied, the empty container(s) 12 may be removed from the support structure 14 via a hoisting mechanism. In some embodiments, the one or more empty containers 12 may be positioned on another bulk storage system 32 (e.g., a transportation unit, a skid, a pallet, or some other holding area) until they can be removed from the site and/or refilled. In other embodiments, the one or more empty containers 12 may be positioned directly onto a transportation unit for transporting the empty containers 12 away from the site. It should be noted that the same transportation unit used to provide one or more filled containers 12 to the location may then be utilized to remove one or more empty containers 12 from the site. One of the advantages of the collapsible nature of the containers 12 in accordance with the present invention is that many more empty containers 12 can be removed from the well site than was previously possible given the compact space that the containers 12 occupy in their collapsed state.

Figure 5:
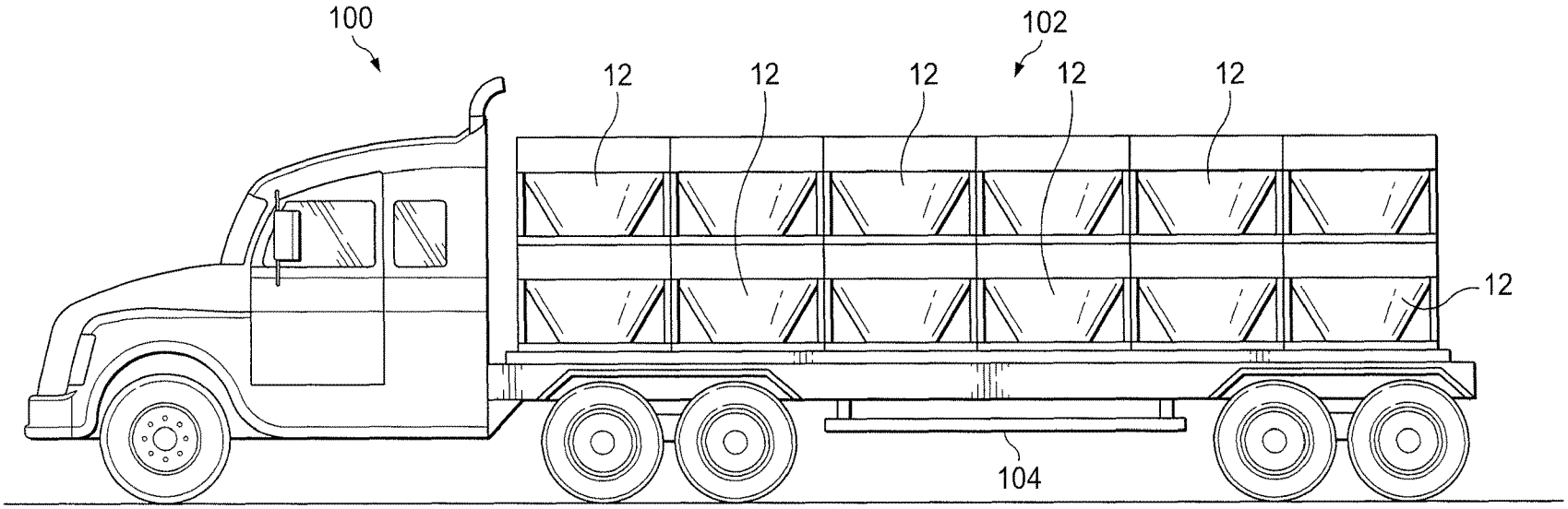
FIG. 5 is a schematic diagram of an embodiment of a plurality of collapsible particular matter containers in accordance with the present disclosure incorporated into a bulk material transportation unit.

The embodiment shown in FIG. 5 illustrates an embodiment wherein the collapsible containers 12 in accordance with present disclosure are incorporated into the bins of a large transportation unit such as the Halliburton Mountain Mover® trailer system discussed above. The bulk storage system in accordance with this embodiment is referenced generally by numeral 100. The system 100 includes transportation unit 102, which may be a trailer, which can be connected to tractor or one-piece truck. The transportation unit 102 has a plurality of collapsible containers 12 disposed on the unit in a stacked configuration. The collapsible containers 12 may have the structure described with reference to FIGS. 2-4. The plurality of collapsible containers 12 may be arranged so as to form the bins or silos of the Mountain Mover® trailer system. The discharge openings of the bottom row of collapsible containers 12 empty the bulk material contents onto a conveyor 104, which in turn may deliver the bulk material to the blender unit 20.

Although the present disclosure and its advantages have been described in detail, it should be understood that various changes, substitutions and alterations can be made herein without departing from the spirit and scope of the disclosure as defined by the following claims.

What is claimed is:

1. A bulk storage container, comprising:

a collapsible frame defined by a rigid upper support structure, a rigid lower support structure, a first support member, and a second support member;

a pair of tracks formed along opposite sides of the lower support structure, wherein a first end of the first support member is coupled to a first end of the upper support structure and a second end of the first support member is coupled to a first track of the pair of tracks, wherein a first end of the second support member is coupled to a second end of the upper support structure and a second end of the second support member is coupled to a second track of the pair of tracks, wherein the first support member and the second support member transition between an expanded position and a collapsed position by sliding the second end of the first support member and the second end of the second support member horizontally along the pair of tracks, and wherein the first support member and the second support member extend to a fully vertical position in the expanded position;

an actuator coupled to the first support member at one end;

a storage sack having an upper portion coupled to the upper support structure and a lower portion coupled to the lower support structure, the lower portion being a conical taper-shaped, wherein the upper portion of the storage sack is formed of a plurality of connected panels, wherein the plurality of panels are at least one of one or more rigid panels and one or more semi-rigid panels.

2. The bulk storage container according to claim 1, wherein the upper support structure is rectangular shaped and the lower support structure is rectangular shaped.

3. The bulk storage container according to claim 1, wherein the first support member is coupled to one side of the upper and lower support frames and the second support member is coupled to an opposite side of the upper and lower support frames.

4. The bulk storage container according to claim 3, further comprising another actuator coupled to the second support member.

5. The bulk storage container according to claim 3, further comprising a cross bar coupling the first support members to the second support member.

6. The bulk storage container according to claim 1, wherein the storage sack comprises a material selected from the group consisting of a cloth, a canvas, a canvas coated with a rubber material, a canvas coated with an elastomeric material, a woven nylon, woven polyethylene, a plastic, a woven glass coated with a rubber material, a woven glass coated with an elastomeric material, a gunny sack and combinations thereof.

7. The bulk storage container according to claim 1, wherein the lower portion of the storage sack is formed of a flexible material.

8. The bulk storage container according to claim 1, wherein the storage sack has an interior formed of a plurality of connected tension panels.

9. The bulk storage container according to claim 1, further comprising a pair of tubes formed along opposite sides of the lower support frame, a cross-section of the tubes being shaped to accommodate the forks of a forklift.

10. The bulk storage container according to claim 1, further comprising a discharge opening formed in the lower portion of the storage sack, the discharge opening being equipped with a material control device selected from the group consisting of a valve, swing gate, pinch gate, annular pinch valve, butterfly valve, and combinations thereof.

11. The bulk storage container according to claim 1, wherein the collapsible frame is adapted to partially collapse upon the storage sack to enable transportation of the bulk material on a bed of a transportation unit.

12. The bulk storage container according to claim 1, wherein the lower portion of the storage sack is coupled to the lower support structure by one of a rope or panel.

13. The bulk storage container according to claim 1, further comprising a sonic or ultrasonic vibrator coupled to the lower portion of the storage sack.

14. The bulk storage container according to claim 1, further comprising another collapsible frame wherein the collapsible frames are stackable.

15. A bulk storage system, comprising:

a transportation unit; and one or more bulk storage containers disposed on the transportation unit, the one or more bulk storage containers comprising:

a collapsible frame defined by a rigid upper support structure, a rigid lower support structure and a first support member and a second support member;

a pair of tracks formed along opposite sides of the lower support structure, wherein a first end of the first support member is coupled to a first end of the upper support structure and a second end of the first support member is coupled to a first track of the pair of tracks, wherein a first end of the second support member is coupled to a second end of the upper support structure and a second end of the second support member is coupled to a second track of the pair of tracks, wherein the first support member and the second support member transition between an expanded position and a collapsed position by sliding the second end of the first support member and the second end of the second support member horizontally along the pair of tracks, and wherein the first support member and the second support member extend to a fully vertical position in the expanded position;

an actuator coupled to the first support member at one end; and a storage sack having an upper portion coupled to the upper support structure and a lower portion coupled to the lower support structure, the lower portion being a conical taper-shaped, wherein the upper portion of the storage sack is formed of a plurality of connected panels, wherein the plurality of panels are at least one of one or more rigid panels and one or more semi-rigid panels.

16. The bulk storage system according to claim 15, further comprising a conveyor disposed beneath one or more bulk storage containers.

17. The bulk storage system according to claim 16, wherein the one or more bulk storage containers comprising a discharge opening formed in the lower portion of the storage sack, the discharge opening being equipped with a material control device selected from the group consisting of a valve, swing gate, pinch gate, annular pinch valve, butterfly valve and combinations thereof.

18. The bulk storage system according to claim 15, wherein the first support member is coupled to one side of the upper and lower support frames and the second support member is coupled to an opposite side of the upper and lower support frames, and comprises another actuator coupled to the second support member.

19. The bulk storage system according to claim 15, further comprising a sonic or ultrasonic vibrator coupled to the lower portion of the storage sack of the one or more bulk storage containers.

* * * * *